US006604262B2

(12) United States Patent
Wang

(10) Patent No.: US 6,604,262 B2
(45) Date of Patent: Aug. 12, 2003

(54) METHOD FOR 3-D ENGAGEMENT OF A FASTENER AND A SEPARATE-TYPE FASTENER FORMED BY THIS METHOD

(76) Inventor: Shih-Chang Wang, 3 Fl., No. 56, Sec. 5, Nan-King East Road, Taipei (TW)

( * ) Notice: Subject to any disclaimer, the term of this patent is extended or adjusted under 35 U.S.C. 154(b) by 0 days.

(21) Appl. No.: 10/016,756

(22) Filed: Oct. 29, 2001

(65) Prior Publication Data

US 2003/0033695 A1 Feb. 20, 2003

(30) Foreign Application Priority Data

Jul. 13, 2001 (TW) ..... 90117190 A

(51) Int. Cl.[7] ..... A44B 19/38; A44B 19/40

(52) U.S. Cl. ..... 24/388; 24/390; 24/427; 24/433

(58) Field of Search ..... 24/432, 387, 388, 24/390, 435, 433, 434, 427, 428, 410–412

(56) References Cited

U.S. PATENT DOCUMENTS

| | | | | | |
|---|---|---|---|---|---|
| 1,703,924 | A | * | 3/1929 | Cobb | 24/406 |
| RE17,437 | E | * | 9/1929 | Statham | |
| 2,077,350 | A | * | 4/1937 | Sundback | 24/401 |
| 2,273,732 | A | * | 2/1942 | Quisling | 156/66 |
| 2,415,643 | A | * | 2/1947 | Legat | 24/401 |
| 2,665,467 | A | * | 1/1954 | Bosomworth et al. | 24/400 |
| 3,849,843 | A | * | 11/1974 | Alberts | 24/401 |
| 4,139,927 | A | * | 2/1979 | Heimberger | 24/434 |
| 4,236,284 | A | * | 12/1980 | Kamiya | 24/411 |
| 4,536,923 | A | * | 8/1985 | Murakami | 24/433 |
| 5,396,685 | A | * | 3/1995 | Wilk | 24/390 |
| 5,608,952 | A | * | 3/1997 | Wilder | 24/433 |
| 5,991,980 | A | * | 11/1999 | Meager | 24/400 |
| 6,088,888 | A | * | 7/2000 | Oda | 24/433 |

FOREIGN PATENT DOCUMENTS

JP 09151917 A * 6/1997 ..... A44B/18/00

* cited by examiner

*Primary Examiner*—James R. Brittain
(74) *Attorney, Agent, or Firm*—Bucknam and Archer

(57) ABSTRACT

A method for 3-D engagement of a fastener, in which fastener teeth of two fastener strips received in different height-level within slider can be engaged together in the same plan by the siding action of slider. The present invention also discloses a separate-type fastener enabling 3-D engagement, comprising first and second fastener strip each of which has a plurality of equi-distance fastener teeth alternately arranged on each of two opposed long substrates respectively so that a plurality of projecting portions and recesses with corresponding shape, which can engage with the recesses and projecting portions of opposite strip, are formed on the side edge walls of fastener teeth on each of first and second fastener strips respectively, a slider having front and rear end wherein inlet ports at high-level and low-level are formed respectively at different heights of the front end. These inlet ports extend along a central plan at rear end and merge at this common central plan, a common outlet port being formed at the rear end of said slider. After one end of each of the first and second strip is passing respectively through the inlet port at high-level and low-level, fastener teeth on each of first and second fastener strip passing through outlet port can be meshed on the same plan by the sliding action of said slider.

13 Claims, 6 Drawing Sheets

METHOD FOR 3-D ENGAGEMENT OF A FASTENER AND A SEPARATE-TYPE FASTENER FORMED BY THIS METHOD

BACKGROUND OF THE PRESENT INVENTION

The present invention relates to a 3-D fastener, particularly to separate-type fastener formed by this method, in which a large interface space is not required for the engagement between strips. This fastener can be widely used in the connection of the interfaces between hard objects so as to extend the working range of the objects.

In general, the structure of a conventional fastener includes separate type and unseparate type etc. In view of the nature of plan-engagement, the purpose of the conventional fastener is confined to the connection between two halves of flexible objects, for example, such as clothe or handbag etc., and is, however, not suitable for connection between interfaces of two hard objects (e.g., furnitures, cases, cabinets or interior building materials). The reasons are set forth as below:

1. An unseparated-type fastener 1 is shown in FIG. 1, wherein the lower ends of each fastener strips 10, 11 are merged together by a lower stopper 13. Thus, the interfaces of each of the applied objects to be connected have one end in unseparated state. If this fastener is used in a hard object, then it can not be opened. This is the first reason.
2. A separated-type fastener 1' is shown in FIG. 1*a*, wherein the lower end of one fastener strip 10 has a pin 13*a*, while the lower end of the other fastener strip 11 has a lower stopper 13 having a receiving space therein. After the insertion of said pin 13*a* into said receiving space within lower stopper 13 of the fastener strip 11 followed by the passing of pin 13*a* through the guide-groove of slider 14, the fasteners 10 and 11 can be engaged together by the sliding action of slider 14. Although the two fastener strips 10 and 11 can be separated completely, the flexibility of fastener strips and enough interface space for the turning-around of fastener strips are two necessary conditions for the pin 13*a* to be smoothly inserted into the receiving space within lower stopper 13 of the fastener strip 11. If this is used for the connection of interface between two hard objects, the pin 13*a* will not be easy to be inserted into the receiving space. This is the second reason.
3. As shown in FIG. 1*b*, two inlet ports 14*a*, 14*b* for fastener strips 10 and 11 are respectively provided at the front end of slider 14 of above-mentioned conventional fastener 1, 1' and merged into a common outlet 14*c* at the rear end of slider 14. After the introduction of strips 10, 11 into the inlet ports 14*a*, 14*b* of slider 14, a planar engagement between the teeth on each of strips 10, 11 can be achieved by the sliding action of slider 14. As shown in FIG. 1*b*, a V-shaped opening is formed between strips 10 and 11 at the un-engaged side. Thus, the slider 14 can not be moved smoothly if the conventional fastener is used for the connection of interface between two hard objects. This is the third reason for the restriction of application for conventional fastener.

SUMMARY OF THE INVENTION

In view of the above-mentioned restriction of application for a conventional fastener, the inventor of the present invention has diverted to the designing of a 3-D fastener and finds that flexibility of strips and the large interface space are not required for the engagement between strips for a 3-D engagement method. Thereby, the defect and disadvantage of conventional fastener can be improved.

The main object of the present invention is to provide a method for 3-D engagement of a fastener, in which fastener teeth of each of two fastener strips received in different height-level within slider can be engaged together on the same plan by the siding action of slider.

Another object of the present invention is to provide a separate-type fastener enabling 3-D engagement and formed by this 3-D engagement method, wherein two separated strips can be engaged by moving these strips closed together so as to cause fastener teeth to be in an overlapped state. This fastener can be widely used in the connection of the interfaces between hard objects so as to extend the working range of the objects.

Above and the other objects of the present invention can be obtained by the fastener of the present invention, mainly comprising: first and second fastener strip, each of which has a plurality of equi-distance fastener teeth alternately arranged on each of two opposed long substrate respectively, so that a plurality of projecting portions and recesses with mating shape, which can engage with the recesses and projecting portions of opposite strip, are formed by the side edge walls of fastener teeth on each of first and second fastener strips respectively; a flexible long guide plate being provided respectively at both ends of first strip to act as a start and termination stopper for the stroke of slider, and a male buckle being provided respectively at the outside of said flexible long guide plate; a guiding bracket, corresponding to the start and termination stopper for the stroke of slider, being provided respectively at both ends of second strip, and a female buckle being provided respectively at the outside of said guiding bracket; a slider having front and rear end wherein inlet ports at high-level and low-level are formed respectively at different height-levels of the front end, and extend along a central plan at rear end and merging at this common central plan, and a common outlet port being formed at the rear end of said slider; after easy positioning of said male and female buckles at both start-ends of fastener strips, fastener teeth on each of first and second fastener strip passing through outlet port being able to engage at the same level by the sliding action of said slider.

BRIEF DESCRIPTION OF ACCOMPANIED DRAWINGS

The objects and advantages of the present invention will become more apparent by the detailed description of preferred embodiment of the present invention by reference to the accompanied drawings, in which:

FIG. 1 is a perspective schematic view of a conventional fastener;

FIG. 1*a* is a schematic view showing the structure of conventional separated type fastener, wherein the slider is shown by dotted lines;

FIG. 1*b* is a schematic view showing the structure of panar engagement of a conventional fastener, wherein the slider is shown by dotted lines;

Figure 3:
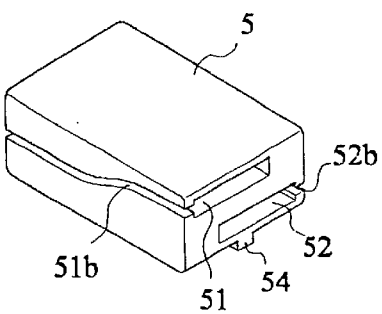
FIG. 3 is a front perspective view of a slider of the present invention.
Figure 3A:
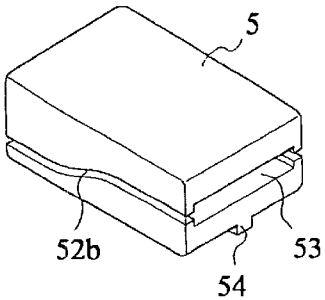
Figure 3B:
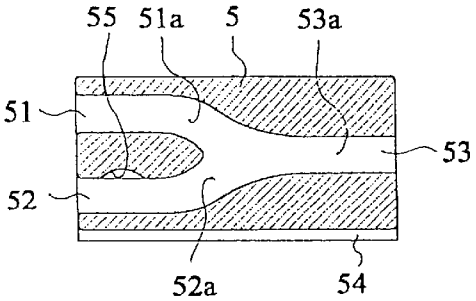
Figure 4B:
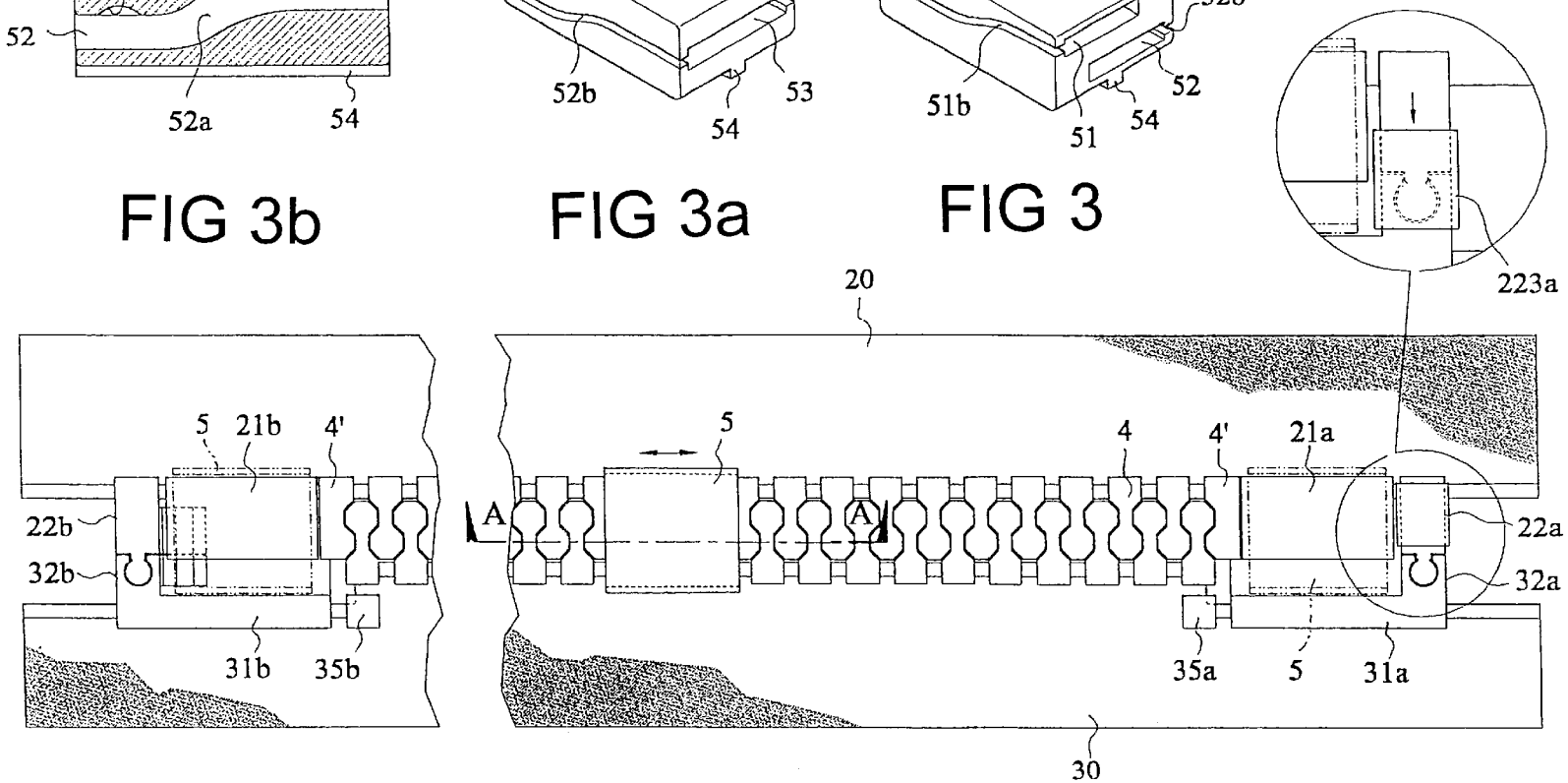
Figure 4:
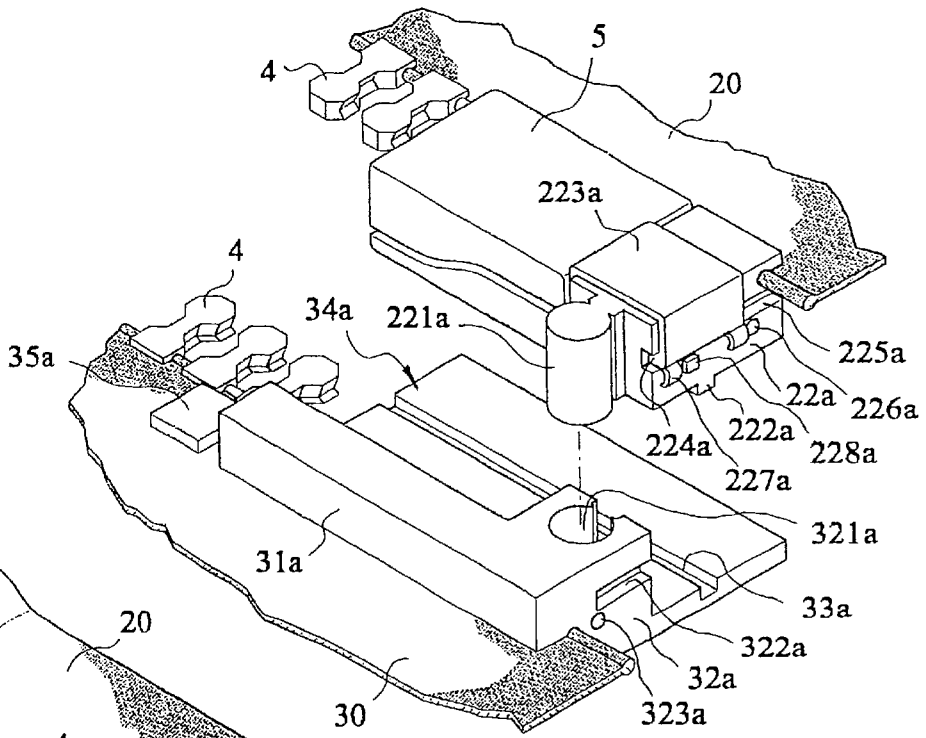
Figure 4A:
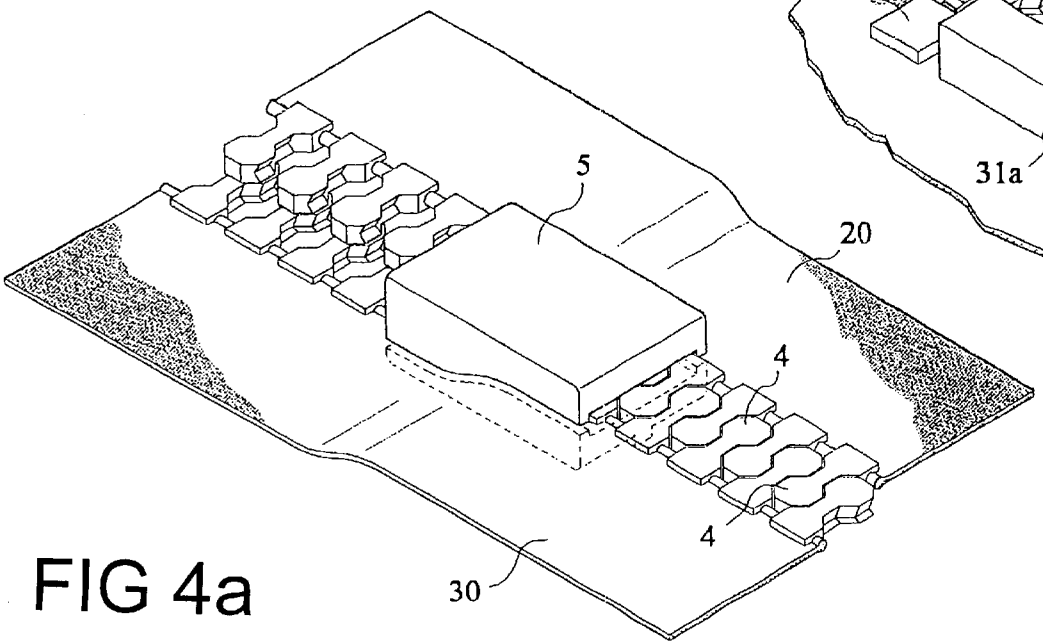
Figure 5A:
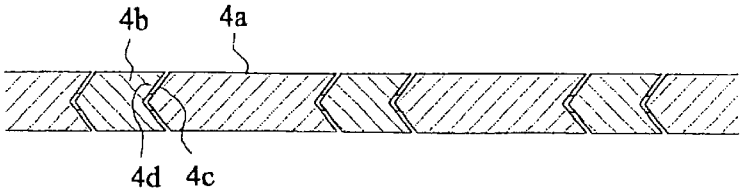
Figure 5:
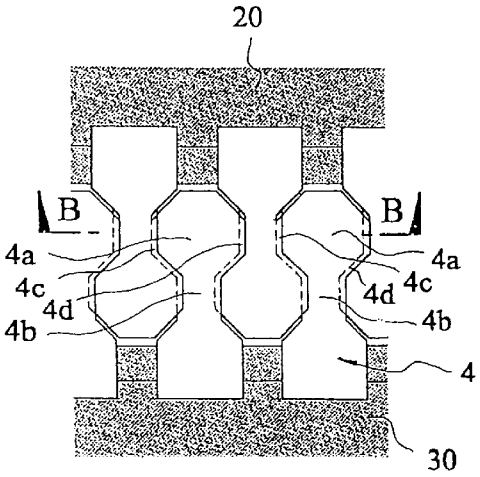
Figure 5B:
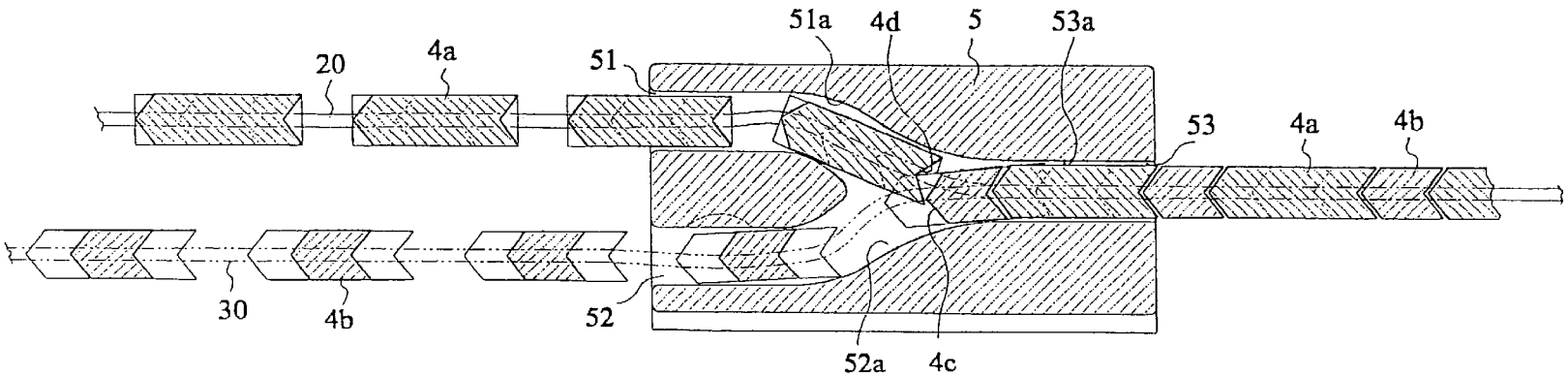
Figure 6A:
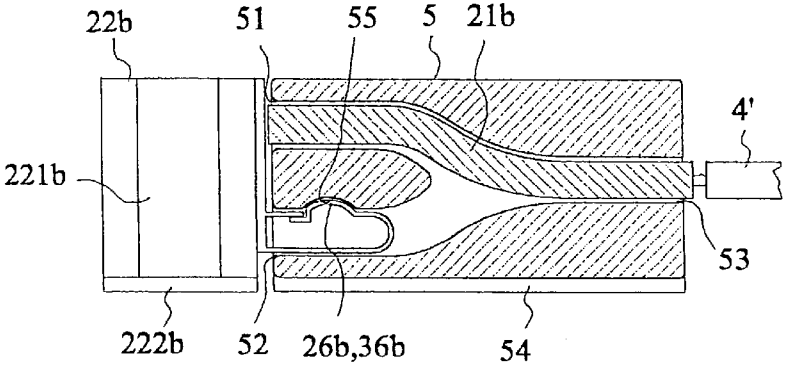
Figure 6:
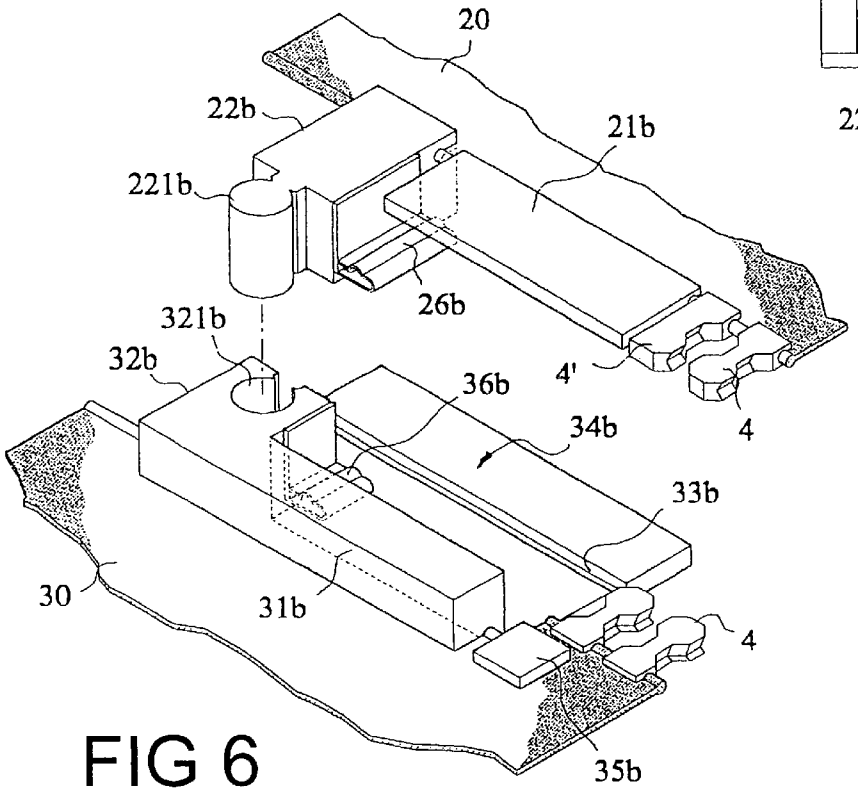

FIG. 3*a* is a rear perspective view of a slider of the present invention;

FIG. 3*b* is a sectional schematic view of a slider of the present invention;

FIG. 4 is a partly enlarged perspective view showing separated state at start end of a fastener of the present invention;

FIG. 4*a* is a partly perspective view showing the fastener of the present invention in engagement state;

FIG. 4*b* is a plan schematic view showing the fastener of the present invention in engagement state;

FIG. 5 is a plan enlarged view showing the fastener of the present invention in engagement state;

FIG. 5*a* is a sectional schematic view taken from B—B line in FIG. 5;

FIG. 5*b* is a sectional schematic view taken from A—A line in FIG. 4*b*, showing 3-D engagement state of fastener teeth within slider;

FIG. 6 is a partly enlarged perspective view showing separated state at termination end of a fastener of the present invention;

FIG. 6*a* is a sectional schematic view showing the slider of the present invention in stagnation state at termination end;

DETAILED DESCRIPTION OF A PREFERRED EMBODIMENT

Firstly, 3-D engagement method, suitable for the interface connection between hard objects such as wood, metal, plastics, rubber, polymer, and material having hardness after special treatment etc., of the present invention will be described. The present invention is designed based on the fact that hard object usually lacks for flexibility and requires space for turn-around. In the present invention, two interfaces of objects to be connected are moved close together so as to cause fastener teeth to be in an overlapped state. After easy positioning of the start-end, two strips on different height-levels can be meshed together at the same level. The engagement between these strips is suitable for that case in which the strips lack for flexibility and space for turn-around, thus it can improve the insufficiencies and disadvantage of conventional fastener.

Figures 1, 1A, 1B:
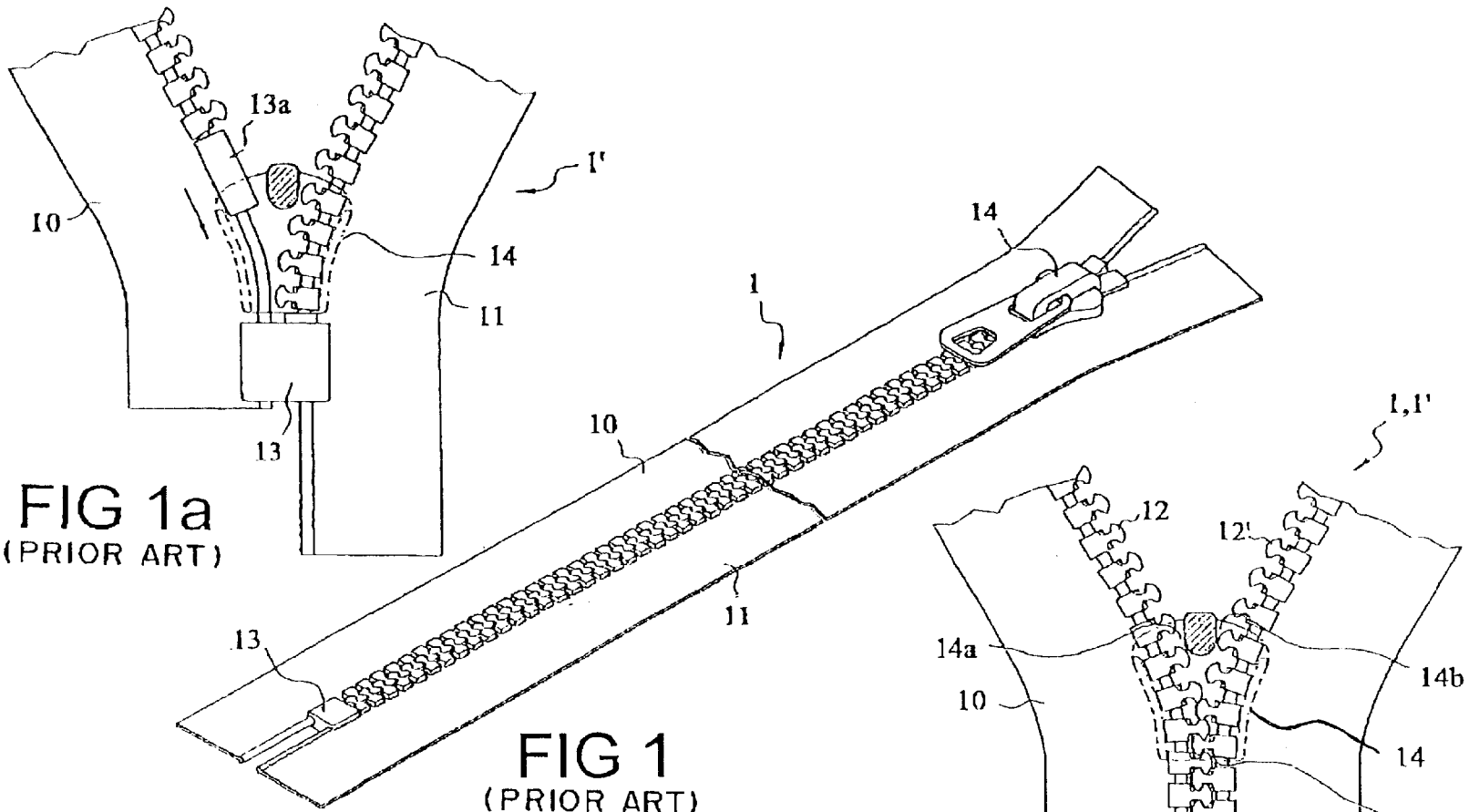
FIG 1b (PRIOR ART)
FIG 1 (PRIOR ART)
FIG 1a (PRIOR ART)
Figure 2:
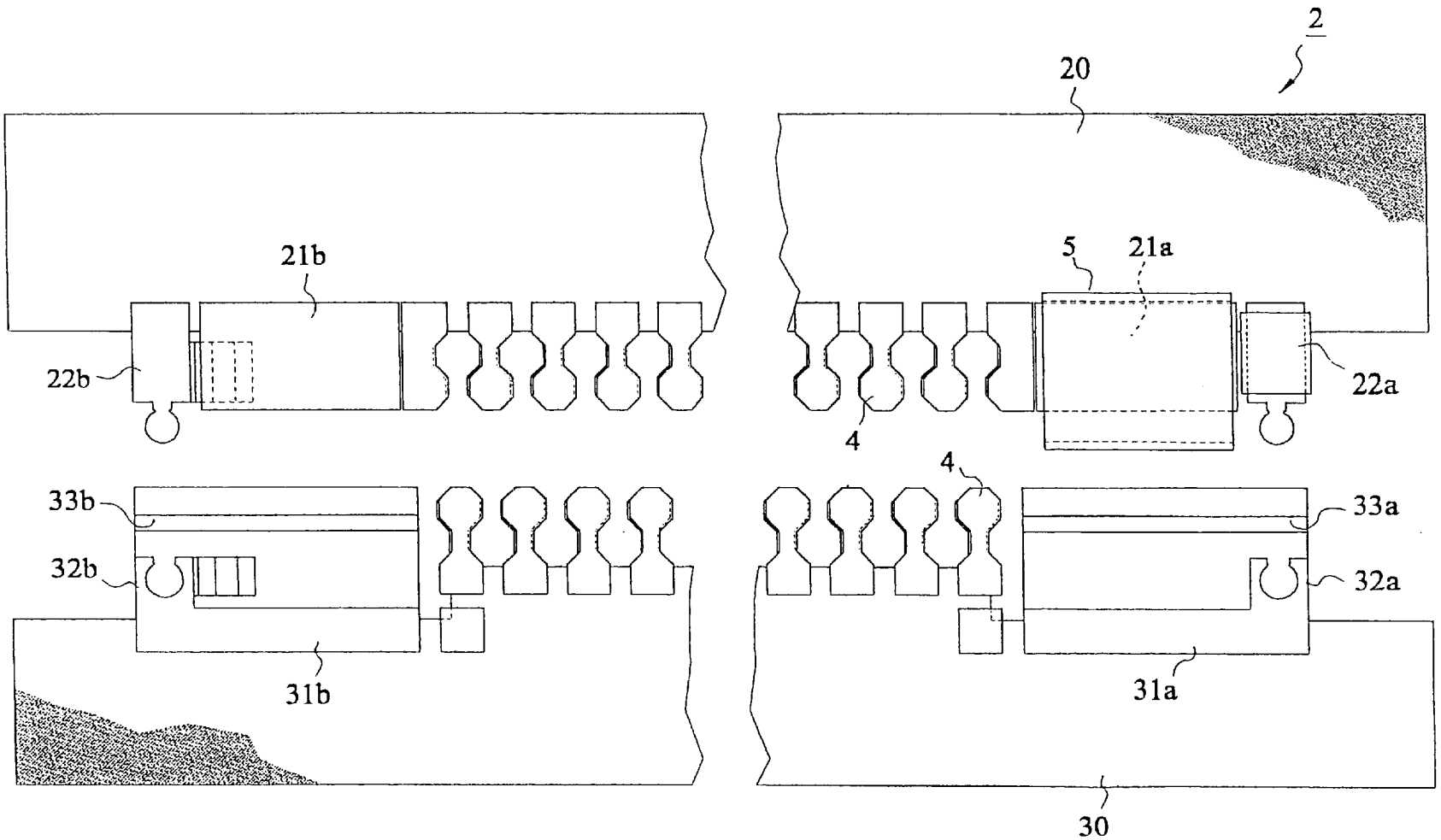
FIG. 2 is a schematic plan view showing a separated-type fastener enabling 3-D engagement of the present invention.

FIG. 2 illustrates a separated-type fastener 2 of the present invention, which comprises a first fastener strip 20 and a second fastener strip 30 each of which has a plurality of equi-distance fastener teeth 4 alternately arranged on each of two opposite long substrates respectively, so that a plurality of projecting portions and recesses with corresponding shapes being formed respectively by the side walls of teeth 4 on each of the two strips 20 and 30, which can mesh with the recesses and projecting portions of opposite strip. Flexible long guide plates 21*a*, 21*b* are provided respectively at both ends of the first strip 20 to act as a start and termination stopper for the stroke of a slider, and male buckles 22*a*, 22*b* are provided respectively at the outside of said flexible long guide plates 21*a*, 21*b*. Guiding brackets 31*a*, 31*b*, corresponding to the start and termination stoppers for the stroke of a slider, are provided respectively at both ends of second strip 30, and female buckles 32*a*, 32*b* are provided respectively at the outside of said guiding brackets 31*a*, 31*b*. Longitudinal guide grooves 33*a*, 33*b* are provided respectively on said guiding brackets 31*a*, 31*b*.

Referring to FIGS. 3 to 3*b*, a slider 5 has front and rear ends wherein inlet ports 51, 52 at high-level and low-level are formed respectively on different height-levels at the front end. An arcuate guiding surface 51*a* is formed downwardly from the inlet port 51 of high-level, while another arcuate guiding surface 52*a* is formed upwardly from the inlet port 52 of low-level. Both of these surfaces extend forward along a central plan 53*a* at rear end, and merge at this common central plan 53*a*. A common outlet port 53 is formed at the rear end of slider 5. A slit 51*b* is formed on the side wall of slider 5 and extends from the inlet port 51 of high-level downwardly, while the other slit 52*b* extends from the inlet port 52 of low-level upwardly. These slits 51*b*, 52*b* are for the emerge-out of the first fastener strip 20 and the second fastener strip 30 respectively. Additionally, a longitudinal guide rib 54 is provided at the bottom of slider 5.

Referring to FIGS. 4 to 4*b*, the male buckle 22*a* at the start-end of first fastener strip 20 has a pin 221*a* and a longitudinal guide rib 221*a* provided at the bottom. When the fastener 2 according to the present invention is in separated state, the slider 5 is slidingly provided on the first fastener strip 20 in such a manner that the inlet port 51 of high-level is positioned at the start-end of flexible long guide plate 21*a* (see FIG. 4*b*), which can be made of rubber or metal spring plate etc. and can be bent within the inlet port 51 of high-level of the slider 5. The front end of said flexible long guide plate 21*a* has a leading fastener tooth 4', which is provided neighborhood with said flexible long guide plate 21*a* so that the fastener teeth 4 can be introduced smoothly upon the sliding action of slider 4. An eyehole 321*a* is provided on the female buckle 32*a* at the start-end of the second fastener strip 30 in such a manner that it can engage with the pin 221*a* of the male buckle 22*a* at the outside of the guide bracket 31*a*. A receiving space 34*a* is provided at front end of the female buckle 32*a* for the positioning of slider 5. In addition, the engagement of the longitudinal groove 33*a* at the bottom of female buckle 32*a* with both the guide rib 222*a* at the bottom of male buckle 22*a*, and the guide rib 54 at the bottom of slider 5 also results in precise positioning so as to guide the slider 5 sliding smoothly. A supporting fixed piece 35*a* is provided at front end of guide bracket 31*a*, which can make initial fastener tooth 4 positioned at a height corresponding to inlet port 52 of low-level of slider 5, so that fastener teeth 4 will slide into the inlet hole 52 of low-level smoothly.

Additionally, the male buckle 22*a* has a sliding plate 223*a*, on two sides of which are provided with projecting portions 224*a*. Sliding grooves 225*a*, 322*a* are provided respectively on the side wall of male buckle 22*a* and side wall of female buckle 32*a* for the sliding of sliding plate 223*a* therein. Four arcuate retaining pieces 227*a* are provided at four corners of said sliding plate 223*a*. Spherical projections 226*a*, 323*a* correspondingly matching with the retaining pieces 227*a* are provided respectively below said sliding grooves 225*a*, 322*a*. In addition, a stopper 228*a* is provided at the opposite end of spherical projections 226*a* on the side wall of male buckle 22*a* so as to prevent the sliding plate 223*a* from being released. During the engagement of the male buckle 22*a* with the female buckle 32*a*, said sliding plate 223*a* can be pushed in the direction of the female buckle 32*a* so that the retaining pieces 227*a* can buckle on the spherical projection 323*a* into a retained state. Accordingly, the engagement between the male buckle 22*a* and the female buckle 32*a* will not be released (as shown in the partly enlarged view in FIG. 4*b*). When the male buckle 22*a* and the female buckle 32*a* is to be disengaged, said sliding plate 223*a* is retreated in the direction of the male buckle 32*a* so that the retaining pieces 227*a* will buckle on the spherical projection 226*a*. Thus, the male buckle 22*a* and the female buckle 32*a* can be disengaged into separated state.

As described above, after the positioning of the first fastener strip 20 and the second fastener strip 30 by the engagement between the male buckle 22*a* and the female buckle 32*a*, the slider 5 is pushed by user's finger to move forward along the longitudinal guide groove 33*a* of the guide bracket 31*a*, so that the second fastener strip 30 can be introduced into the inlet port 52 of low-level (as shown in FIG. 4*a* and FIG. 4*b*).

Referring next to FIGS. 5 to 5*b*, a fastener tooth 4 has a head portion 4*a*, a neck portion 4*b* and a projecting portion 4*c* and recess portion 4*d* provided on its side wall. Fastener teeth 4, head portion 4*a* and neck portion 4*b* are arranged alternately, while projecting portion 4*c* and recess portion 4*d* can mate with each other. FIG. 5*b* is a sectional view taken along A—A line. During sliding of the slider 5, the first fastener 20 is introduced into the inlet port 51 of high-level, while the second fastener 30 is introduced into the inlet port 52 of low-level. Both the first and the second fastener 20, 30 slide along the guide surface 51*a*, 52*a* in the direction of central plan at rear end. In view of the fact that the guide surface 51*a* of the inlet port 51 of high-level is arcuate downwardly and the guide surface 52*a* of the inlet port 52 of low-level is arcuate upwardly, the recess portion 4*d* and projecting portion 4*c* of fastener teeth 4 of the first fastener strip 20 can engage with the projecting portion 4*c* and recess portion 4*d* of fastener teeth 4 of the second fastener strip 30 at the merging place of both subsequently, the fastener merged together can be discharged through outlet port 53.

Referring next to FIGS. 6 and 6*a*, the male buckle 22*b* at the termination end of the first fastener strip 20 has a pin 221*b* and a guide rib 222*b* at the bottom. A flexible long guide plate 21*b* is provided at the inside of said male buckle 22*b*. The inside wall of said male buckle 22*b* is provided with a clip spring 26*b* with projection, the height of which matchs to that of the inlet port 52 of low-level of the slider 5. An eyehole 321*b* is provided on the female buckle 32*b* at the outside of guide bracket 31*b* at termination-end of the second fastener strip 30 in such a manner that it can engage with the pin 221*b* of male buckle 22*b*. A receiving space 34*b* is provided at the inside of female buckle 32*b* for the accomodation of slider 5. The longitudinal guide groove 33*b* at the bottom of female buckle 32*b* can be engaged with the guide rib 222*b* at the bottom of male buckle 22*b* and with the guide rib 54 at the bottom of the slider 5. Also, the inside wall of said female buckle 32*b* is provided with a clip spring 36*b* with projection, the height of which corresponds to that of the inlet port 52 of low-level of the slider 5. When the slider 5 slides to the termination-end, the pin 221*b* of male buckle 22*b* is inserted into the eyehole 321*b* of female buckle 32*b*, and the slider 5 is received within the receiving space 34*b* of bracket 31*b*, and the inlet port 51 of high-level is terminated on the flexible long guide plate 21*b* at termination-end of the first fastener strip 20. An arcuate recess 55 is provided at upper wall of the inlet port 52 of low-level of the slider 5, which can engage with said clip spring 26*b*, 36*b* for stopping (as shown in FIG. 6*a*).

While the present invention has been illustrated and described by preferred embodiments of the present invention, it is for illustrative purpose only and should not be considered as limitation of the present invention. Any modification and variation of equivalence should be considered within the range of the present invention without departing from the spirit and the range of claims of the present invention.

Summing up the above, flexibility of strips and large interface space are not required for the engagement between strips for a 3-D engagement method and a separated-type fastener formed by this method of the present invention. Therefore, the fastener of the present invention can be widely used in the connection of interfaces between hard objects. Accordingly, the defects and disadvantage of conventional fastener can be improved. The range of application of fastener of present can be widely expanded.

| Symbol list of major components | |
|---|---|
| 2 | fastener of the present invention |
| 20 | first fastener strip |
| 21a, 21b | flexible long guide plate |
| 22a, 22b | male buckle |
| 221a, 221b | pin |
| 222a, 222b | guide rib |
| 223a | sliding plate |
| 224a | projecting portion |
| 225a | sliding groove |
| 227a | retaining piece |
| 26b | clip spring |
| 30 | second fastener strip |
| 31a, 31b | guide bracket |
| 32a, 32b | female buckle |
| 321a, 321b | eyehole |
| 322a | sliding groove |
| 33a, 33b | logitudinal guide groove |
| 34a, 34b | receiving space |
| 35a, 35b | supporting fixed piece |
| 36b | clip spring |
| 4 | fastener teeth |
| 4' | leading fastener tooth |
| 4a | head portion |
| 4b | neck portion |
| 4c | projecting portion |
| 4d | recess portion |
| 5 | slider |
| 51 | inlet port of high-level |
| 52 | inlet port of low-level |
| 51a, 52a | guiding surface |
| 53 | outlet port |
| 53a | central plan |
| 51b, 52b | slit |
| 54 | guide rib |

What I claimed is:

1. A separated-type fastener of 3-D engagement, comprising:

a first fastener strip (20) and a second fastener strip (30), each of which is fixed on an opposite long substrate and has a plurality of equi-distance fastener teeth (4) alternately arranged on each of two opposite sides of said strips respectively, and each tooth having projecting portions (4*c*) and recess portions (4*d*) with corresponding shape formed respectively on two meshing side walls of each tooth (4) of the two strips (20) and (30);

a pair of flexible long guide plates (21*a*, 21*b*), being provided respectively at both ends of said first fastener strip (20), and male buckles (22*a*, 22*b*) being provided at an outside of said flexible long guide plates (21*a*, 21*b*) respectively;

a pair of guide brackets (31*a*, 31*b*), being provided respectively at both ends of said second fastener strip (30), said guide brackets (31*a*, 31*b*) having female buckles (32*a*, 32*b*) at both outsides;

a slider (5), having both front and rear ends wherein inlet ports (51, 52) at high-level and low-level are formed respectively at different heights of the said front end, said inlet ports (51, 52) extending along a central plane (53*a*) at a rear end and merging at this common central plane, a common outlet port being formed at the rear end of said slider (5);

when said first and second fastener strips (20,30) are in a separated state, the slider (5) is positioned at a start-end of one of the flexible long guide plates; after the buckling of the associated said male buckle with its associated said female buckle, said first and second fastener strips (20, 30) being able to be engaged on the same plane after introducing respectively through both high-level and low-level inlet ports (51, 52) by the sliding action of said slider (5).

2. The separated-type fastener of 3-D engagement in accordance with claim 1, wherein an arcuate guiding surface (51*a*) is formed downwardly from inside of the inlet port (51) of high-level, while another arcuate guiding surface (52*a*) is formed upwardly from inside of the inlet port (52) of low-level, both of these surfaces merging on a common plane.

3. The separated-type fastener of 3-D engagement in accordance with claim 2 wherein a slit (51*b*) is formed on a side wall of the slider (5) extending from the inlet port (51) of high-level downwardly, while another slit (52*b*) extends from the inlet port (52) of low-level upwardly.

4. The separated-type fastener of 3-D engagement in accordance with claim 2, wherein a longitudinal rib (54) is provided at a bottom of said slider (5).

5. The separated-type fastener of 3-D engagement in accordance with claim 1, wherein receiving spaces (34*a*, 34*b*) are provided respectively on said guide brackets (31*a*, 31*b*).

6. The separated-type fastener of 3-D engagement in accordance with claim 1, wherein longitudinal guide grooves (33*a*, 33*b*) corresponding to the said longitudinal rib (54) are provided on said guide brackets (31*a*, 31*b*).

7. The separated-type fastener of 3-D engagement in accordance with claim 1 wherein said male buckle at the start-end of the flexible long guide plate of said first fastener strip (20) has a sliding plate (223*a*), on both sides of which are provided with projecting portions (224*a*), and sliding groves (225*a*, 322*a*) are provided respectively on side walls of said male buckle and side walls of said female buckle for the sliding of said sliding plate (223*a*) on said male buckle located at the start-end and its associated female buckle.

8. The separated-type fastener of 3-D engagement in accordance with claim 7, wherein four arcuate retaining pieces (227*a*) are provided respectively at four corners of said sliding plate (223*a*), spherical projections (226*a*, 323*a*) correspondingly matching individually to said four retaining pieces (227*a*) being provided respectively below said sliding grooves (225*a*, 322*a*).

9. The separated-type fastener of 3-D engagement in accordance with claim 1, wherein clip springs (26*b*, 36*b*) are provided respectively at insides of each of said male buckle (22*b*) at a termination-end of said first fastener strip (20) and said female buckle (32*b*) at a termination-end of said second fastener strip (30).

10. The separated-type fastener of 3-D engagement in accordance with claim 1, wherein said male buckles (22*a*, 22*b*) have pins (221*a*, 221*b*) which can be inserted into eyeholes (321*a*, 321*b*) on said female buckles (32*a*, 32*b*).

11. The separated-type fastener of 3-D engagement in accordance with claim 1, wherein an arcuate recess (55) is provided at an upper wall of said inlet port (52) of high-level of said slider (5).

12. The separated-type fastener of 3-D engagement in accordance with claim 11, wherein said arcuate recess (55) of said inlet port (52) of high-level can be clipped onto clip springs (26*b*, 36*b*) of said male and female buckles (22*b*, 32*b*) at the final stroke of said slider (5).

13. A separated-type fastener enabling 3-D engagement, comprising two fastener strips each having a plurality of equi-distance teeth alternately arranged thereon; a slider having inlet ports provided respectively on two sides at one end and a common outlet port at the other end by merging two guide surfaces of said two inlet ports, said two fastener strips being able to mesh together after introducing from said two inlet ports separately by the sliding action of said slider positioned by a suitable positioning means, wherein:

said positioning means includes a pair of flexible long guide plates (21*a*, 21*b*) provided separately at both ends of one of said two fastener strips, male buckles (22*a*, 22*b*) being provided separately at an outside of said each flexible long guide plate (21*a*, 21*b*);

a pair of guide brackets (31*a*, 31*b*) being provided at both ends of the other of said two fastener strips, female buckles (32*a*, 32*b*) being provided outside of said guide brackets (31*a*, 31*b*).

* * * * *